US008303350B2

(12) United States Patent
Skowranek

(10) Patent No.: US 8,303,350 B2
(45) Date of Patent: Nov. 6, 2012

(54) ELECTRICAL APPARATUS HAVING A SCREW TERMINAL

(75) Inventor: Antje Skowranek, Horn-Bad Meinberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/062,822

(22) PCT Filed: Sep. 7, 2009

(86) PCT No.: PCT/EP2009/006536

§ 371 (c)(1),
(2), (4) Date: Apr. 15, 2011

(87) PCT Pub. No.: WO2010/028812

PCT Pub. Date: Mar. 18, 2010

(65) Prior Publication Data

US 2011/0183552 A1 Jul. 28, 2011

(30) Foreign Application Priority Data

Sep. 9, 2008 (DE) ..... 10 2008 046 467

(51) Int. Cl.
*H01R 4/30* (2006.01)

(52) U.S. Cl. ..... 439/727; 439/797

(58) Field of Classification Search ..... 439/709, 439/712, 713, 715, 717, 721, 722, 723, 724, 439/796–798, 801, 810–815, 727, 728
See application file for complete search history.

(56) References Cited

U.S. PATENT DOCUMENTS 4,669,806 A * 6/1987 Fuchs ..... 439/712
6,074,240 A * 6/2000 Bradshaw et al. ..... 439/412

FOREIGN PATENT DOCUMENTS

| | | | |
|---|---|---|---|
| DE | 1972344 | U | 11/1967 |
| DE | 2947193 | A1 | 6/1981 |
| DE | 3010955 | A1 | 10/1981 |
| DE | 8410539 | U1 | 5/1985 |
| DE | 29714690 | U1 | 10/1997 |
| FR | 2070593 | A5 | 9/1971 |
| FR | 2563947 | A1 | 8/1985 |
| FR | 2723475 | A1 | 2/1996 |
| JP | 04341770 | A1 | 11/1992 |

* cited by examiner

*Primary Examiner* — Ross Gushi
(74) *Attorney, Agent, or Firm* — Nath, Goldberg & Meyer; Jerald L. Meyer; Robert T. Burns

(57) ABSTRACT

The subject matter of the invention is an electrical apparatus (1) having a screw terminal for connecting electrical conductors, comprising a housing (3) with an upper face and a lower face (5, 7) and at least two screw shafts (9) which are arranged next to one another in the housing (3), wherein the screw shafts (9) each have a screw feed opening (12) on the upper face (5) and extend in the direction of the lower face (7). A transition region (11) connects the screw shafts (9) to one another. Projections (17) are arranged on the inner face of the screw shafts (9). The invention is characterized in that the projections (17) end at or beneath the level of the upper face (5) of the transition region (11), as viewed from the lower face (7), and also the projections (17) are arranged only outside the transition region (11), or at least one first projection (17) is provided outside the transition region (11) and a second projection is provided inside the transition region (11), wherein the radial extent of the second projection is less than that of the first projection (17).

5 Claims, 3 Drawing Sheets

Figure 1:
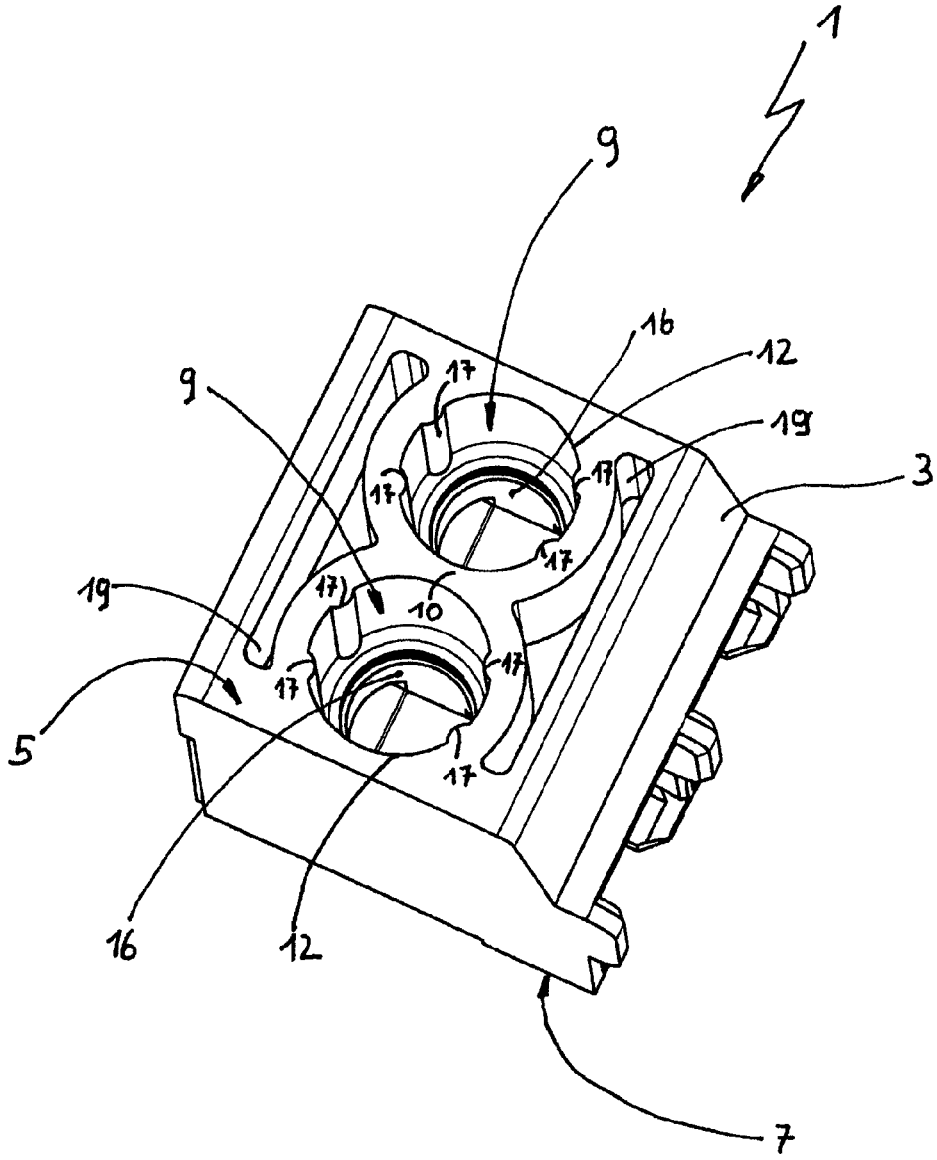

Fig. 3
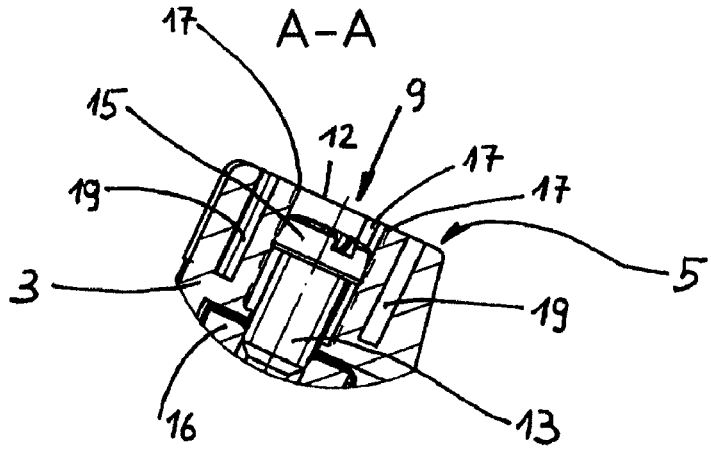
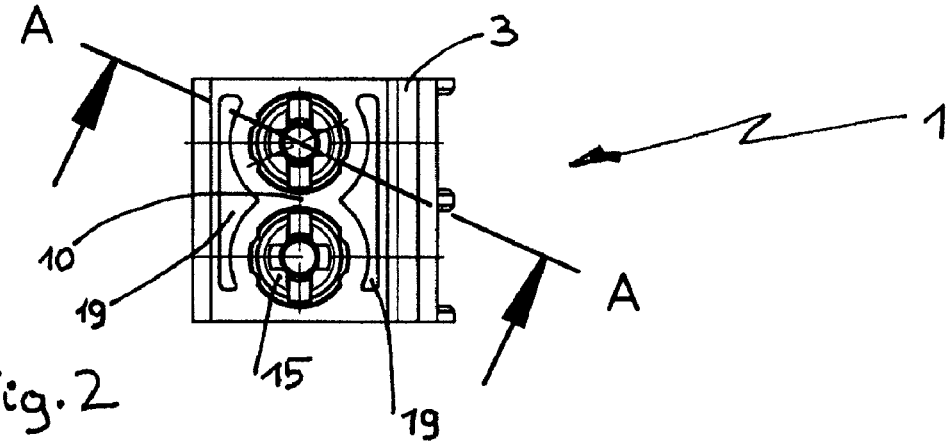
Fig. 2

ELECTRICAL APPARATUS HAVING A SCREW TERMINAL

This is a National Phase Application filed under 35 U.S.C. 371 as a national stage of PCT/EP2009/006536, filed on Sep. 7, 2009 and claims benefit from German Patent Application No. 10 2008 046 467.8 filed on Sep. 9, 2008, the entire content of which is hereby incorporated by reference in its entirety.

The present subject matter relates to an electrical apparatus having a screw terminal for connecting electrical conductors.

Screw terminals comprising projections in the form of bulges or ribs on the inner faces of their screw shafts so that a screw inserted into the screw shaft will be secured against inadvertent loosening from the screw shaft are generally known. This securing is achieved in that the projections reduce the inner diameter of the screw shaft so that the head of an inserted screw applies a radial compressive force to the projections. This keeps the screw head in non-positive contact.

The radial compressive forces exerted by the screw head result in more or less deformation of the housing sections that surround the screw shaft. This makes it more difficult to custom-fit the screw terminal into another arrangement. Several solutions are known that partially absorb the compressive forces and thereby reduce deformation. For example, a screw shaft is known from DE1972344 that comprises openings in the screw shaft for reducing deformation and material tensions.

Deformations and material tensions in multiple screw shafts located next to one another are of particular importance. The compressive forces and the respective deformations and material tensions can add up—and thus multiply—in the direction of the lineup. Solutions for limiting the adverse effects of compressive forces in such screw terminals are known in which the screw shafts are extended by cylindrical screw insertion ducts. These insertion ducts protrude beyond the upper face of the base housing. Especially when the projections mentioned at the outset are only located on the inner faces of the insertion ducts, compressive forces can at best cause deformation of the insertion ducts while the base housing remains largely dimensionally stable. For example, GB903223 discloses such a screw terminal.

Based on GB903223, the problem to be addressed is to develop a flatter screw terminal with projections on the inner face of its screw shaft.

This problem is solved by the non-limiting exemplary embodiments of the present subject matter disclosed herein.

The electrical apparatus according to a non-limiting exemplary embodiment of the present subject matter includes a screw terminal for connecting electrical conductors includes a housing with an upper and a lower face and at least two screw shafts which are arranged next to one another in the housing, wherein

- the screw shafts each have a screw feed opening on the upper face and extend in the direction of the lower face,
- a transition region connects the screw shafts to one another, and
- projections are arranged on the inner face of the screw shafts, wherein
- the projections end at or beneath the level of the upper face of the transition region as viewed from the lower face and
- the projections are only arranged on the outside of the transition region or at least one first projection is provided outside the transition region and a second projection is provided inside the transition region, wherein the radial extent of the second projection is less than that of the first projection.

Since the projections in the screw shaft do not extend above the level of the upper face of the transition range as viewed from the lower face, extension of the screw shafts above the upper face of the transition region can be reduced or eliminated completely. This makes the screw terminal as a whole flatter. A flatter screw terminal has the advantage that it meets the requirements of increased miniaturization in device manufacturing. It is particularly suited for applications that are characterized by low installation heights. This is the case, for example, in device housings and control cabinets.

If the screw shafts are not extended above the level of the upper face of the transition region at all, the entire upper face of housing of the screw terminal is evenly flat without any projections. A housing with a flat upper face has the advantage that it can be removed from the mold more easily and gently. This reduces manufacturing costs, and the housing is exposed to less mechanical strain during its production. In addition, such a screw terminal is easier to install and remove because the screw terminal cannot get caught on screw shafts that protrude beyond its upper face.

Since there are no projections in the screw shaft in the transition region, or if there are, then these extend less in radial direction than other projections outside the transition region, the radial compressive force of the screw head of a screw inserted into the screw shaft is significantly reduced in the transition region. This is particularly advantageous if there are multiple screw shafts or housings arranged next to one another, since significantly smaller compressive forces aggregate in lineup direction. The radial compressive forces will eventually cause more or less deformation of the housing depending on the housing material. It is decisive in this context that deformation of housings in lineup direction is minimal only. If deformations were unfavorably greater, even gaps could develop between directly adjacent housings. This would cause the entire arrangement of lined up housings to distort and/or bend. But because only few compressive forces act in lineup direction and the housings remain largely dimensionally stable in lineup direction, it is ensured that contacts of the screw terminal overlap with the base rail and the screw terminal can be soldered into a printed-circuit board and will function faultlessly. Therefore the present subject matter makes it possible to line up multiple screw shafts or housings, respectively.

In a preferred embodiment, free housing spaces are provided that encompass the screw shafts at least partially. The radial compressive forces of the screw head of a screw inserted into the screw shaft act resiliently onto the walls of the screw shaft in those regions in which the free housing space encompasses the screw shaft. Since the screw shaft walls are resiliently deflected into the free housing space, housing deformation outside the free housing spaces will not occur. The advantageous effect is that the free housing spaces partially absorb the effect of the radial compressive forces, which results in less housing deformation.

When the free housing spaces are located outside the transition region, very small gaps between screw shafts and thus very small divisions of the screw terminal can be achieved.

Another reduction in housing deformation can be achieved if the projections in the screw shaft are exclusively arranged in the free housing spaces. In this particularly preferred embodiment of the invention, the radial compressive forces of a screw head of a screw inserted into the screw shaft will only act resiliently onto the walls. Therefore the radial compressive forces only cause deflection of the screw shaft walls into the free housing spaces. The housing is not deformed, and the outer dimensions of the housing remain completely intact. An additional advantage is that the screw terminal can be custom-fitted into another arrangement.

Another advantage of this embodiment is the material selection for the screw terminal. The resilient effect of the screw shaft wall is mainly based on its low wall thickness that is defined by the free housing space surrounding it. Therefore the radial compressive forces are still resiliently absorbed if the material itself is less elastic, such as thermosetting plastic. As a result, more materials can be selected as housing materials.

The strength of the radial compressive force is proportional to the difference between the diameter of the screw head and the inner diameter of the screw shaft that is reduced by the projections in the screw shaft. Since only the screw shaft walls resiliently absorb the radial compressive forces in this embodiment, larger screw heads can be tolerated than in terminals where these compressive forces act onto a solid housing and deform it as a whole. Therefore larger tolerances of the screw head diameters are acceptable for this embodiment. This simplifies the production of the screws, especially of very small screws, and reduces production costs.

In one embodiment of the invention, the projections in the screw shaft extend from the screw feed opening in the direction of the lower face over a portion of the screw shaft only. The advantage is that the head of an inserted screw is held in non-positive contact even in the upper portion of the screw shaft. This secures the screw against inadvertent loosening before the screw has even been turned into the first pitches of the thread.

It is particularly simple in terms of process engineering if the projections as viewed from the lower face towards the screw feed opening only extend along a foremost portion of the screw shaft. This embodiment of the invention is characterized in that the projections in the screw shaft do not have a recess for engagement on their rear. This allows particularly simple and gentle demolding.

This is also advantageous in terms of housing material selection options. Materials can be selected that, for lack of elasticity, do not allow damage-free demolding if there is a recess for rear engagement.

In a particularly preferred embodiment, the projections extend over the entire length of the screw shaft. The advantage of this embodiment is that the head of an inserted screw is held in non-positive contact even in the upper portion of the screw shaft. This secures the screw against inadvertent loosening before the screw has even been turned into the first pitches of the thread.

Furthermore, this embodiment is advantageous because the projections in the screw shaft do not have a recess for rear engagement. This allows particularly simple and gentle demolding. This is also advantageous in terms of housing material selection options. Materials can be selected that, for lack of elasticity, do not allow damage-free demolding if there is a recess for rear engagement.

An additional advantage results from the fact that the projections reduce the diameter of the screw shaft evenly over the entire length of the screw shaft. In this way, the screw head of an inserted screw evenly applies radial compressive forces over the entire length of the screw shaft. Therefore the screw head is evenly held in non-positive contact over the entire length of the screw shaft. The screw is thus held in position over the entire length of the screw shaft, which produces guidance for the screw.

The electrical apparatus according to the present subject matter and the use of a screw in the electrical apparatus are described below with reference to an example and to the figures.

Figure 4:
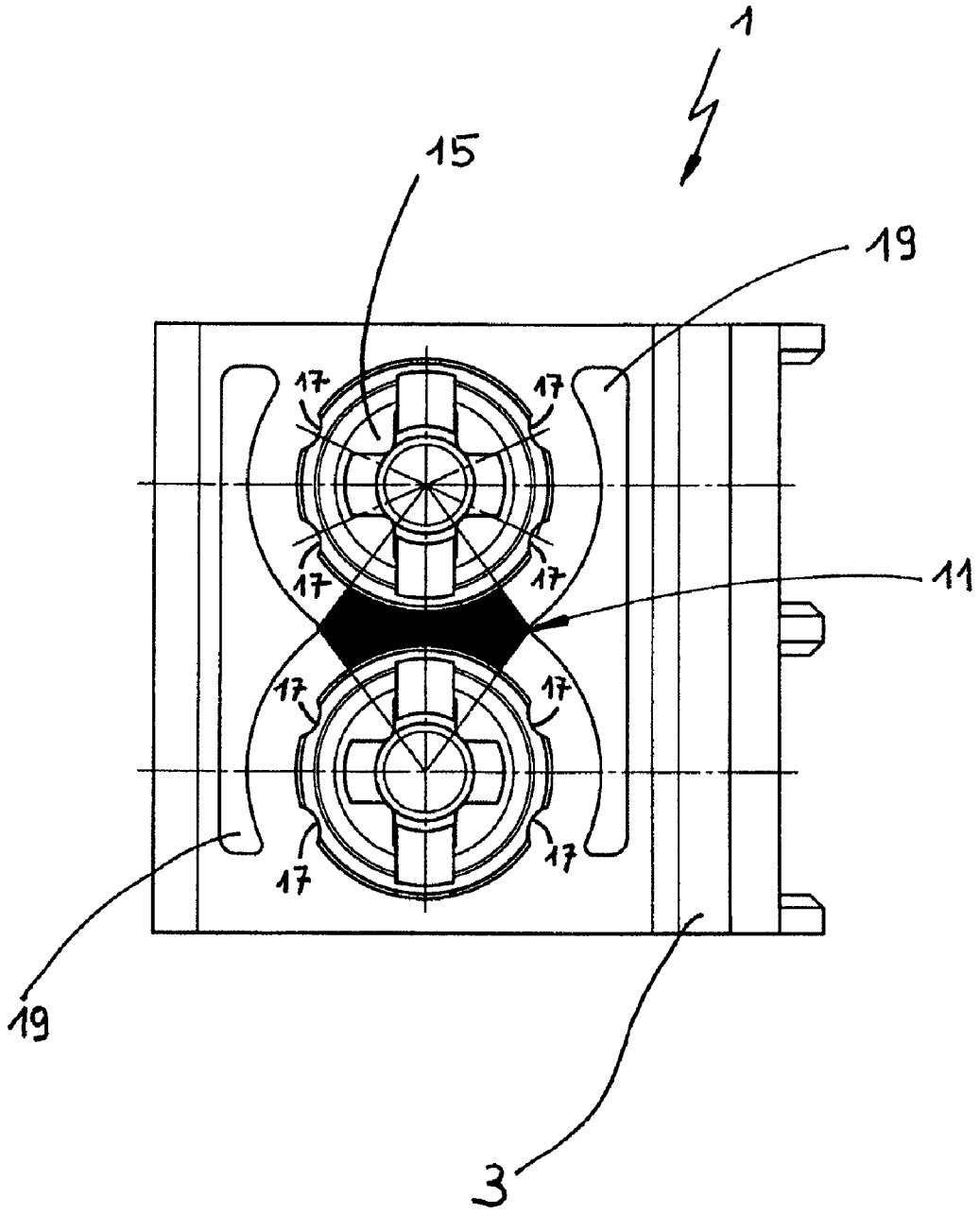

Wherein:

FIG. 1 shows a perspective view of the upper face of the housing of an electrical apparatus according to the invention comprising a housing and two screw shafts arranged next to one another, with projections on the inner faces of the screw shafts and free housing spaces that partially encompass the screw shafts, FIG. 2 shows a top view of the upper face of the housing of the electrical apparatus of FIG. 1 with a screw inserted into the screw shaft, FIG. 3 shows a sectional view through the electrical apparatus along line A-A in FIG. 2, and FIG. 4 shows a top view as FIG. 2, wherein the transition region between the two screw shafts is marked by a solid black area.

FIGS. 1, 2, and 4 show an electrical apparatus 1. It comprises a housing 3 with an upper face 5 and a lower face 7 located opposite the upper face 5. Furthermore, two screw shafts 9 are arranged next and in parallel to one another in the housing 3. In this embodiment, the screw shafts 9 are so close to one another that they are in one section directly connected by a shared screw shaft wall 10 only (see FIGS. 1 and 2). In FIG. 4, the region that connects the adjacent screw shafts 9—i.e. the screw shaft wall 10 in this embodiment—is marked as a solid black area. The screw shafts 9 each comprise a screw feed opening 12 on the upper face 5. In this embodiment, the screw feed opening 12 is level with the upper face 5, which means that the housing 3 has an evenly flat upper face 5, which is apparent, in particular, in FIG. 3. Unlike in prior art, the screw shafts 9 do not protrude beyond the upper face 5 of the transition region 11.

A screw 13 with a screw head 15 can be inserted into the screw shaft 9 via the screw feed opening 12 (see FIG. 3). The screw shaft 9 and the screw head 15 are matched such that the inner diameter of the screw shaft 9 is greater than the diameter of the screw head 15. The screw shafts 9 extend from their screw feed opening 12 in the direction of the lower face 7. As FIGS. 1 and 3 show, a clamping sleeve 16 having a radial internal thread of a screw terminal that is generally known and therefore not described here in detail is located beneath the screw shaft 9 when looking from the upper face 5 towards the lower face 7. The screw shaft 9 and the clamping sleeve 16 are matched such that the thread of the screw 13 engages in functional position in the radial internal thread of the clamping sleeve 16 so that electrical conductors (not shown) are connected using the screw terminal.

Projections 17 are arranged on the inner faces of the screw shafts 9 (see FIGS. 1, 3, and 4). In this embodiment, the projections 17 extend from the screw feed opening 12 over the entire length of the screw shaft 9, as is particularly apparent in FIG. 3. The inner diameter of the screw shafts 9 is reduced due to the radial extension of the projections 17. The screw shaft 17 and the screw head 15 are matched such that the inner diameter of the screw shaft 9 is greater than the diameter of the screw head 15. The screw head 15 therefore applies a radial compressive force to the projections 17 such that the screw head 15 is held in non-positive contact.

In this embodiment, the housing 3 includes free housing spaces 19 that partially encompass the screw shafts 9. The free housing spaces 19 can also be arranged directly between adjacent screw shafts 9. In the present embodiment, the free housing spaces 19 are outside the transition region 11 that is located between the screw shafts 9. As FIGS. 1 and 4 show the projections 17 are exclusively arranged in the region of the free housing spaces 19 in this embodiment. Therefore the effect of the radial compressive forces applied by the screw head 15 to the projections 17 exclusively results in resilient deflection of the screw shaft walls into the free housing spaces 19.

LIST OF REFERENCE SYMBOLS

Electrical apparatus 1
Housing 3
Upper face 5
Lower face 7
Screw shaft 9
Screw shaft wall 10
Transition region 11
Screw feed opening 12
Screw 13
Screw head 15
Clamping sleeve 16
Projection 17
Free housing space 19

The invention claimed is:

1. An electrical apparatus having a screw terminal for connecting electrical conductors, comprising:

a housing having an upper and a lower face;

at least two screw shafts next to one another in the housing;

a transition region connecting the at least two screw shafts;

projections outside the transition region and on an inner face of at least one of the at least two screw shafts; and at least one free housing space outside the transition region, the at least one free housing space at least partially encompassing the at least two screw shafts and defining screw shaft walls, wherein:

the at least two screw shafts each have a screw feed opening on the upper face and extending toward the lower face; and the projections end in the transition region at or beneath a level of the upper face as viewed from the lower face.

2. The electrical apparatus according to claim 1, wherein the projections are only in a region of the at least one free housing space such that:

a radial compressive force of a screw head inserted into one of the at least two screw shafts only acts resiliently onto the screw shaft walls; and only causes deflection of the screw shaft walls into the at least one free housing space.

3. The electrical apparatus according to claim 1, wherein the projections extend from the screw feed opening in a direction of the lower face across a portion of at least one of the at least two screw shafts screw shaft.

4. The electrical apparatus according to claim 1, wherein the projections, viewed from the lower face in a direction of the screw feed opening, extend across a foremost portion of at least one of the at least two screw shafts.

5. The electrical apparatus according to claim 1, wherein the projections extend in a direction of the lower face until a beginning of a clamping sleeve.

* * * * *